US010265583B1

(12) United States Patent
Zaffino

(10) Patent No.: US 10,265,583 B1
(45) Date of Patent: Apr. 23, 2019

(54) FOAM ROLLER DUET SYSTEM

(71) Applicant: Balanced Body, Inc., Sacramento, CA (US)

(72) Inventor: Jenna Zaffino, Chicago, IL (US)

(73) Assignee: Balanced Body, Inc., Sacramento, CA (US)

( * ) Notice: Subject to any disclaimer, the term of this patent is extended or adjusted under 35 U.S.C. 154(b) by 319 days.

(21) Appl. No.: 15/270,177

(22) Filed: Sep. 20, 2016

Related U.S. Application Data

(60) Provisional application No. 62/281,228, filed on Jan. 21, 2016.

(51) Int. Cl.
*A63B 21/00* (2006.01)
*A63B 26/00* (2006.01)

(52) U.S. Cl.
CPC ..... *A63B 26/003* (2013.01); *A63B 21/00047* (2013.01); *A63B 21/4039* (2015.10); *A63B 2208/0228* (2013.01); *A63B 2208/0252* (2013.01); *A63B 2208/0257* (2013.01); *A63B 2208/0266* (2013.01)

(58) Field of Classification Search
CPC ..... A61H 2015/0007–2015/0014
See application file for complete search history.

(56) References Cited

U.S. PATENT DOCUMENTS

| | | | | |
|---|---|---|---|---|
| 6,560,932 | B2 | 5/2003 | Heroux | |
| 2010/0274165 | A1* | 10/2010 | Evans | A61H 15/00 601/122 |
| 2012/0150082 | A1* | 6/2012 | Davis | A61H 15/0092 601/118 |
| 2013/0123078 | A1* | 5/2013 | Marji | A61H 15/00 482/139 |
| 2016/0059063 | A1* | 3/2016 | Breibart | A63B 23/185 482/123 |

* cited by examiner

*Primary Examiner* — Jennifer M Deichl
(74) *Attorney, Agent, or Firm* — Greenberg Traurig, LLP

(57) ABSTRACT

A system that allows for a variety of exercises for persons in prone, side lying and seated positions that may be executed with ease and stability using two foam rollers removably attached to each other. The system may utilize one or more straps and one or more accessory pieces in conjunction with the foam rollers to not only hold and stabilize two foam rollers together as one piece of equipment, but also to allow for separation for seated exercises. The system allows additional feedback to the right and left hemispheres of the body when the system is utilized by that person.

14 Claims, 23 Drawing Sheets

FOAM ROLLER DUET SYSTEM

CROSS-REFERENCE TO RELATED APPLICATION

This application claims the benefit of U.S. Provisional Application No. 62/222,891 filed Sep. 24, 2015, U.S. Provisional Application No. 62/239,585 filed Oct. 9, 2015 and U.S. Provisional Application No. 62/281,228 filed Jan. 21, 2016 and hereby incorporates the entire disclosure of those applications by reference.

FEDERALLY SPONSORED RESEARCH OR DEVELOPMENT

Not Applicable.

BACKGROUND AND SUMMARY OF THE INVENTION

The system relates generally to a system using two foam rollers to offer options to persons, such as those that practice Pilates or other health directed disciplines, additional feedback to the right and left hemispheres of the body utilizing the "Duet" concept. The vast majority of Pilates exercises are easily accessed through this arrangement of equipment, resulting in muscular symmetry, balance and an increased sense of proprioception for movement through space. By way of the present invention, the foam rollers may be molded together or removably attached to each other. In addition, one or more accessory pieces may be used in conjunction with the foam rollers to not only hold and stabilize two foam rollers together as one piece of equipment, but also to allow for separation for seated exercises. Such accessories would allow for supine, prone, side lying and seated exercises to be executed with ease and stability.

In addition to accessories pieces, the present invention also contemplates the use of one or more nesting blocks or an exercise mat that has provided thereon grooves or other formations, both of which would allow for greater stability in positioning of the duet apparatus containing the foam rollers when secured together.

DETAILED DESCRIPTION OF THE PREFERRED EMBODIMENTS

Figure 1:
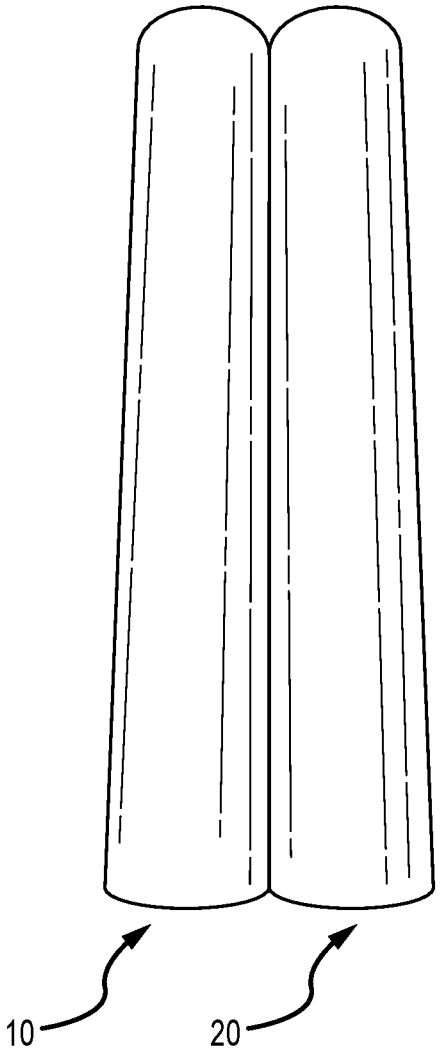
FIG. 1 is a picture of two foam rollers in parallel that are standard in the practice of Pilates and physical fitness disciplines.
Figure 2:
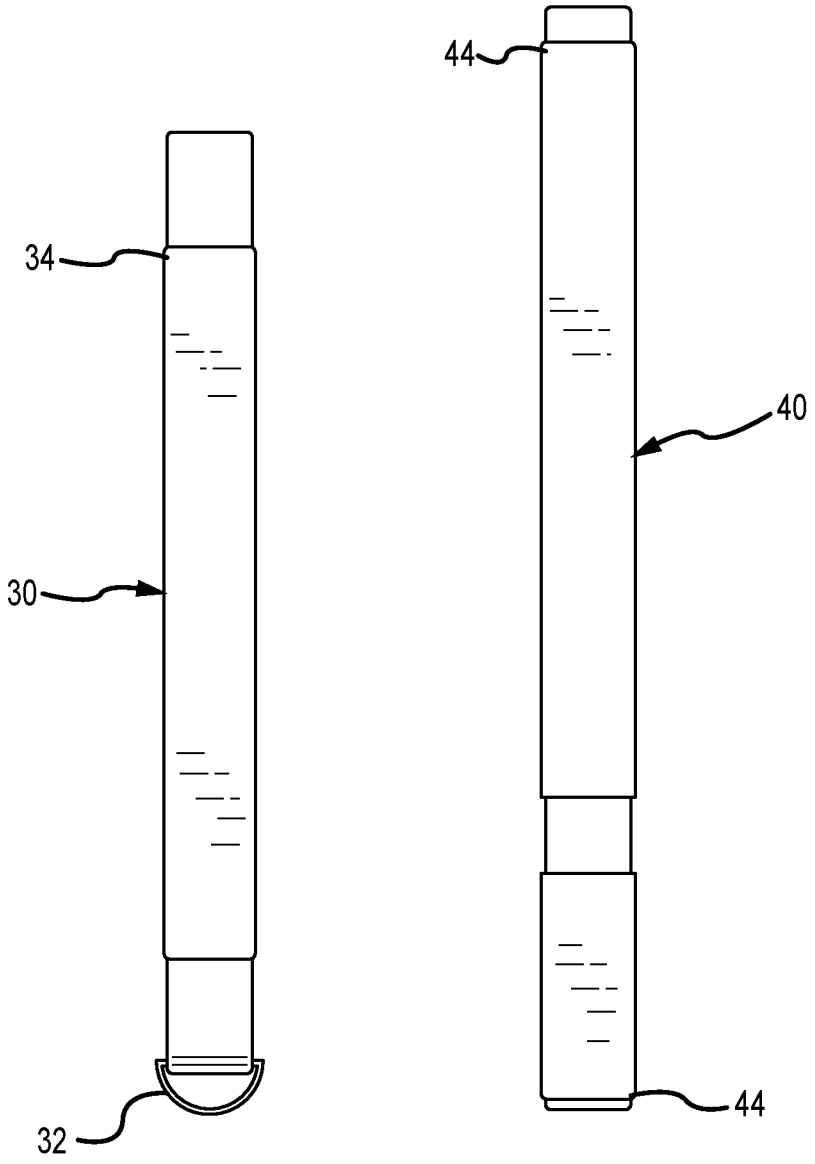
FIG. 2 is a picture of two straps which may be used in one embodiment of the present invention to secure the two foam rollers together.
Figure 3:
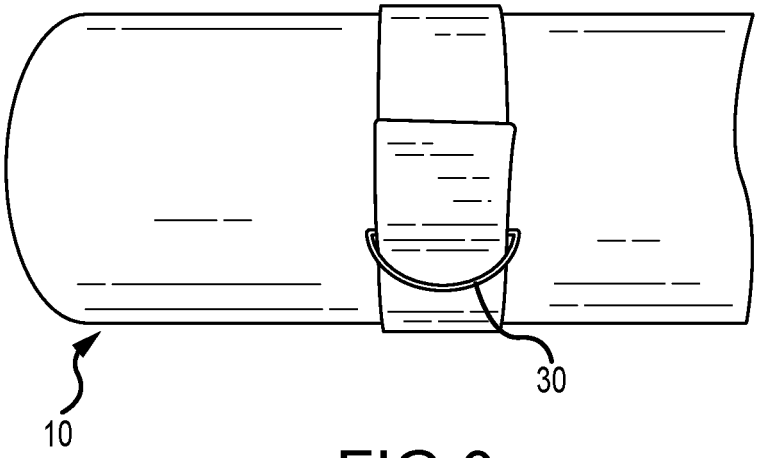
FIG. 3 is a picture of one of the foam rollers of FIG. 1 with one of the straps of FIG. 2 secured to the roller.
Figure 4:
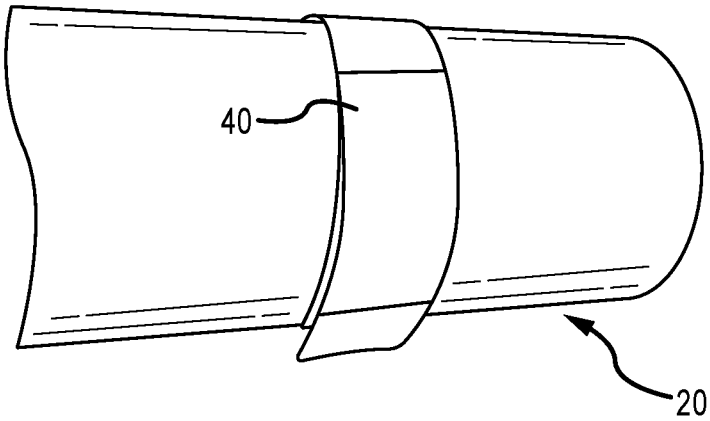
FIG. 4 is a picture of the other foam roller of FIG. 1 with the other strap of FIG. 2 secured to the roller.

The duet foam roller system of the present invention uses standard foam rollers 10, 20 as depicted in FIG. 1. The foam rollers of FIG. 1 may be molded together or secured to each other by other means, such as, for example, a fastener and loop system using Velcro® fasteners. In another embodiment of the present invention, the two foam rollers may be secured to each other with straps 30, 40 as depicted in FIG. 2 to form the duet system depicted in FIG. 5. As shown in FIG. 2, one strap 30 is provided with a ring 32 at one end and fastening material 34, such as Velcro® at the other, while the other strap 40 is provided with fastening material 44 at both ends. The straps may by secured to respective rollers as shown in FIGS. 3 and 4 and then the foam rollers may be secured to each other at one end by mating the straps as shown in FIG. 5.

Figure 2A:
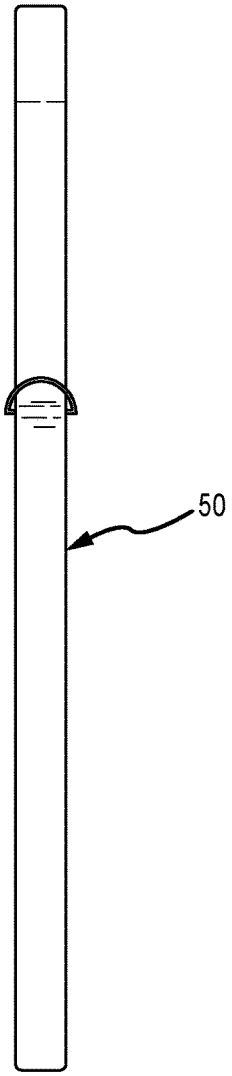
FIG. 2A is a picture of another strap which may be used in another embodiment of the present invention to secure the two foam rollers together.
Figure 7:
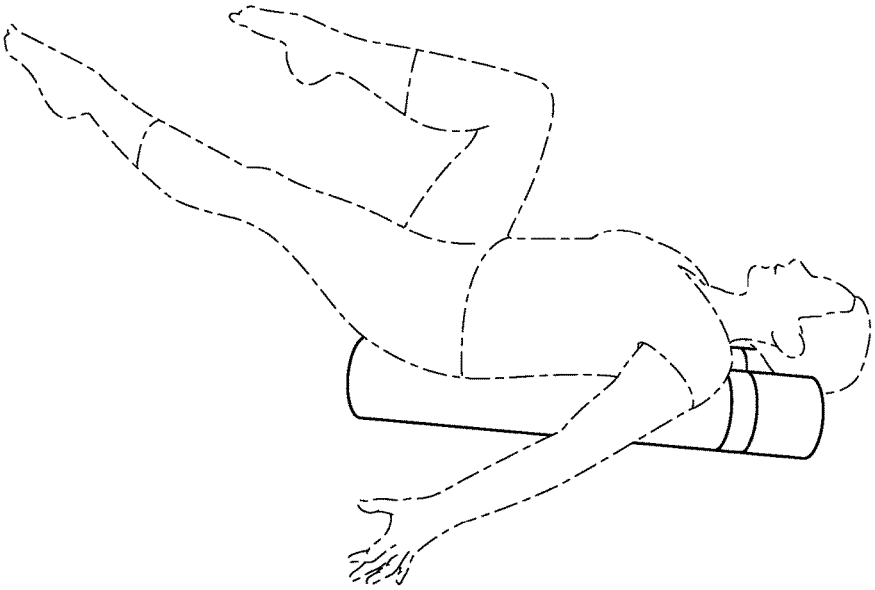
Figure 7A:
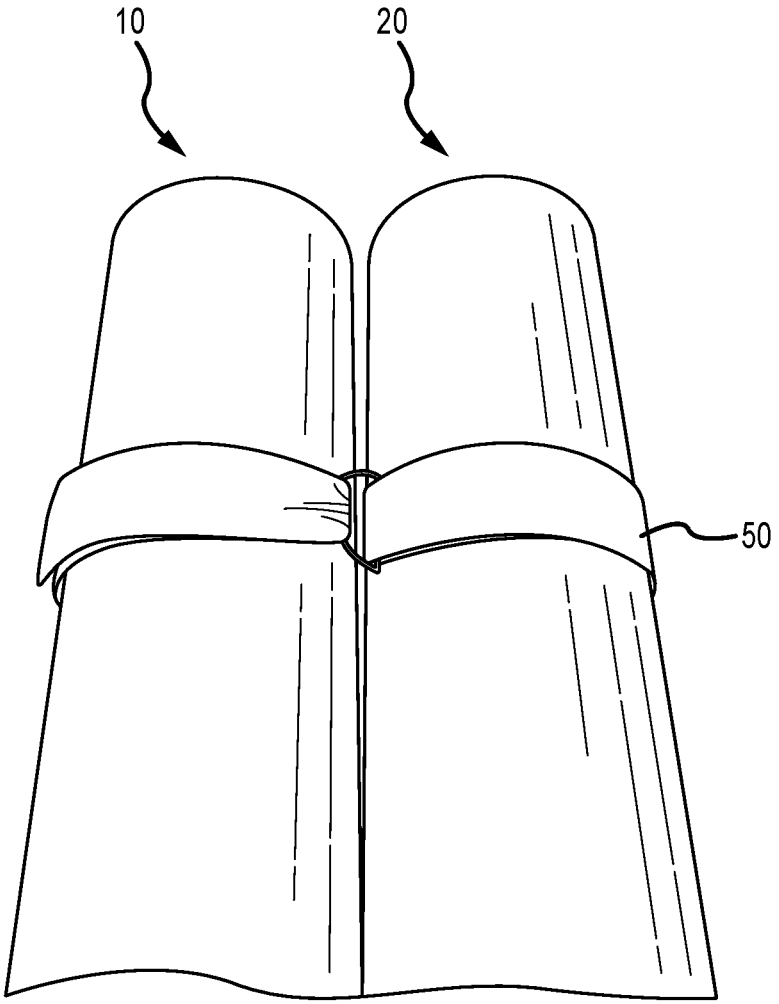
FIG. 7A is a picture of the foam rollers of FIG. 1 with the strap of FIG. 2A securing the rollers together.
Figure 8:
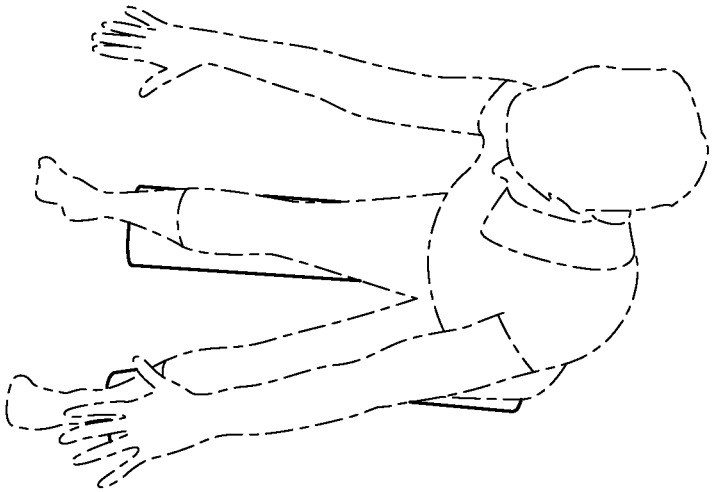
FIGS. 8, 9 and 10 are pictures of the duet foam roller system in use where the foam rollers are secured at one end by straps and separated at the opposite end to form a substantially V-shaped arrangement.

In another embodiment, a single strap 50, such as the one depicted in FIG. 2A, may be used which may be wrapped around the end portions of the two rollers in a FIG. 8 configuration to allow for securing the foam rollers together as shown in FIG. 7A.

Figure 2B:
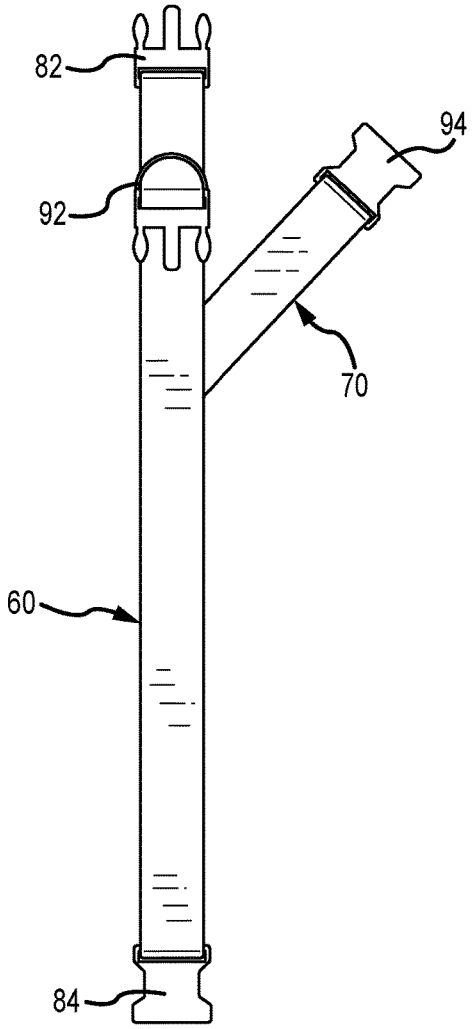
FIG. 2B is a picture of a strap combination having a configuration which includes two sets of mating connectors that may be used in a further embodiment of the present invention to secure the foam rollers together.

In a further embodiment, a strap combination, as depicted in FIG. 2B, may be used where two strap portions 60, 70 are sewed or connected together to form a generally Y-shaped configuration having two sets of female/male connectors, 82, 84 and 92, 94, generally arranged as shown. In use in the system of the present invention the shorter strap, forming one side of the Y, is wrapped around a portion of one foam roller and secured around the roller by connecting the female connector 94 to the nearest mating male connector 92 while the longer end of the strap is wrapped around the other roller and connected to the remaining mating connectors 82 and 84 to hold the foam rollers together. In yet other embodiments, strap combinations using buckles or other mating connectors may be used to secure the rollers together.

Figure 5:
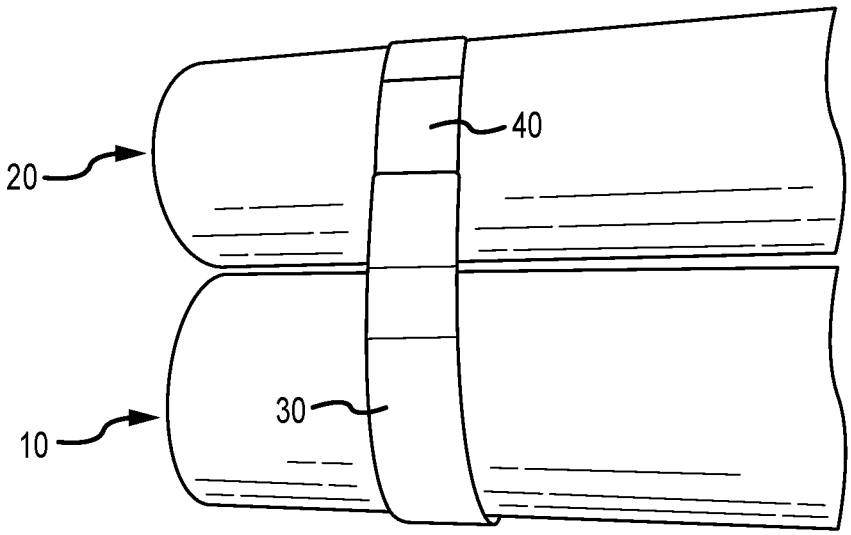
FIG. 5 is a picture of the foam rollers and straps of FIGS. 3 and 4 wherein the straps are secured to each other to provide the duet foam roller system.
Figure 5A:
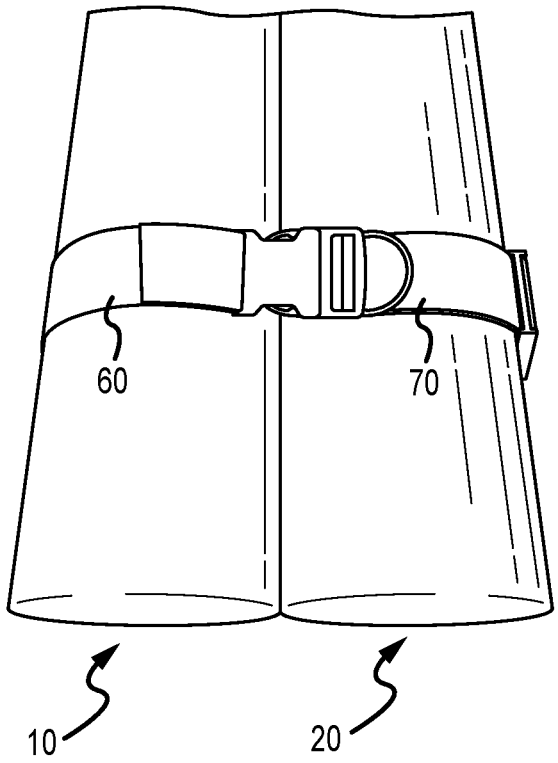
FIGS. 5A and 5B are pictures of the foam rollers and strap combination of FIG. 2B wherein the shorter portion of the strap is secured around one roller and the longer portion of the strap is wrapped around the other roller and then secured by mating to the remaining open connector to secure the rollers together.
Figure 5B:
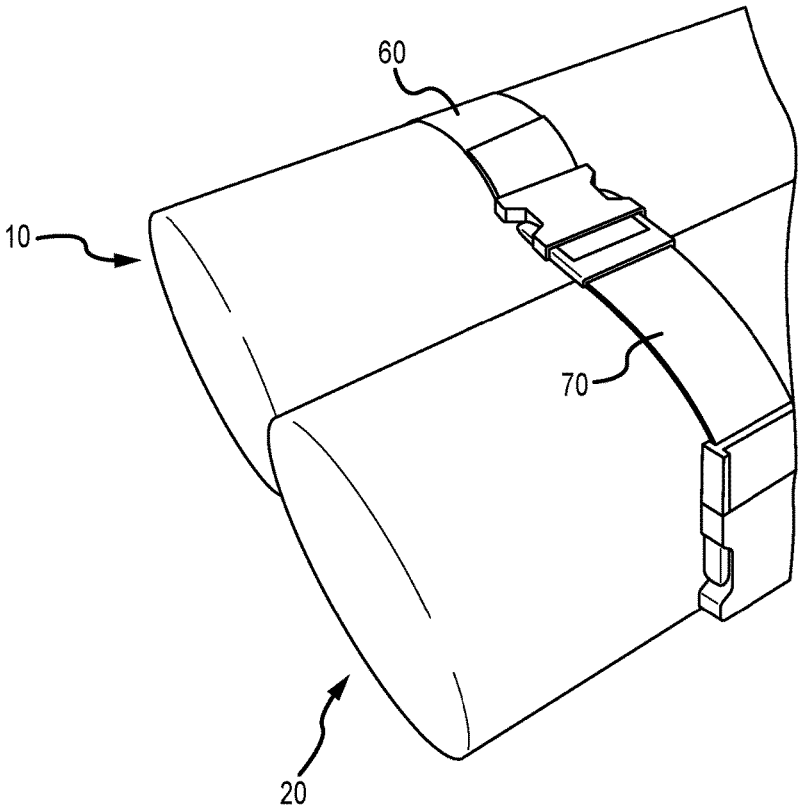
Figure 6:
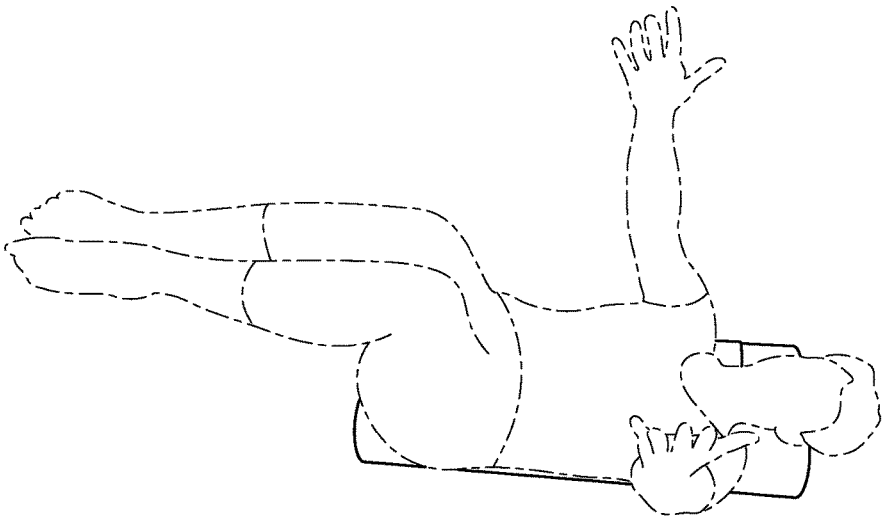
FIGS. 6 and 7 are pictures of the duet foam roller system in use where the foam rollers are substantially parallel to each other.
Figure 7B:
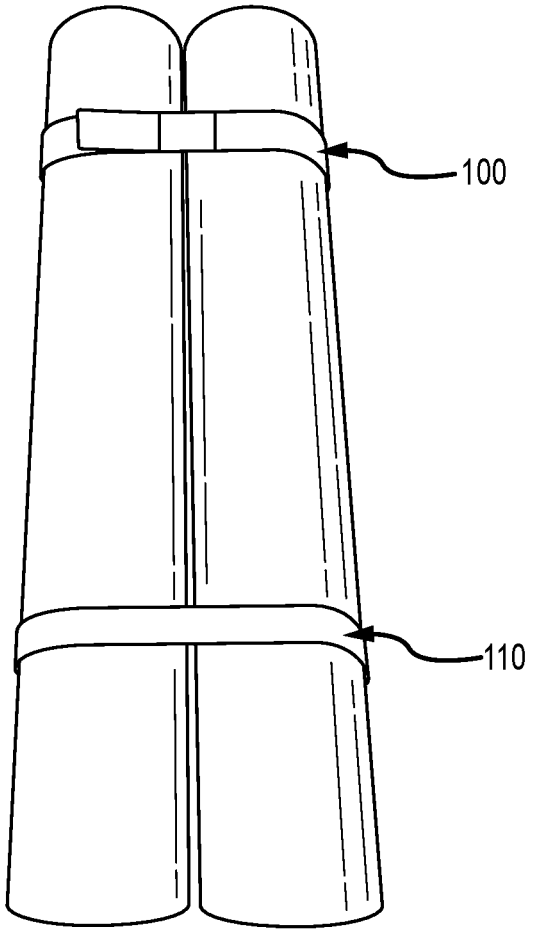
FIG. 7B is a picture of the foam rollers of FIG. 1 with at least two sets of straps of either FIG. 2 or 2A securing the rollers together.
Figure 7C:
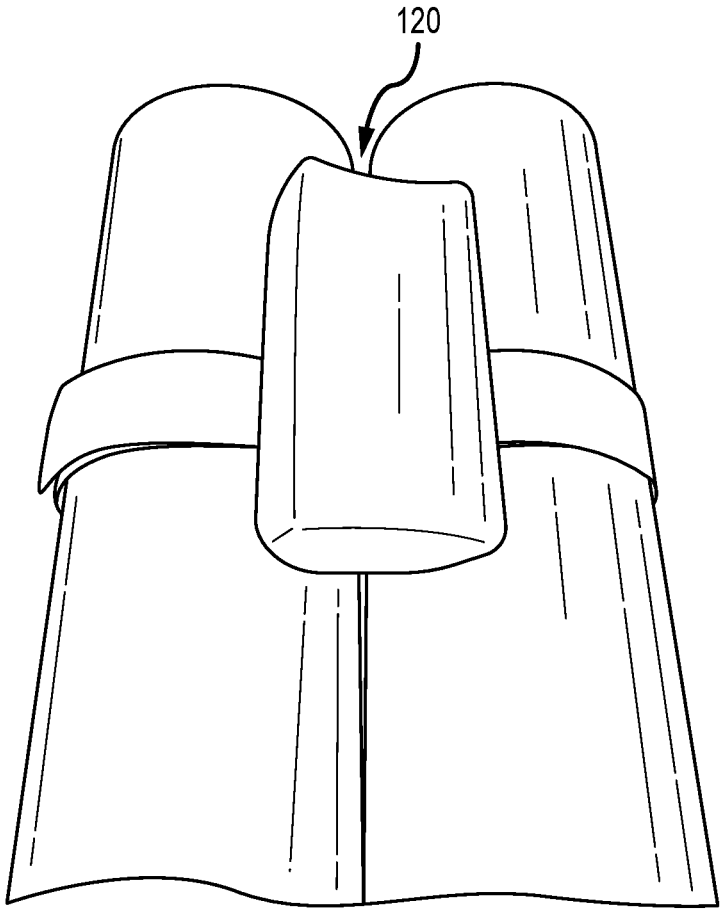
FIG. 7C is a picture of the foam rollers of FIG. 1 with one set of the straps of either FIG. 2 or 2A securing the rollers together and including a support pillow.
Figure 7D:
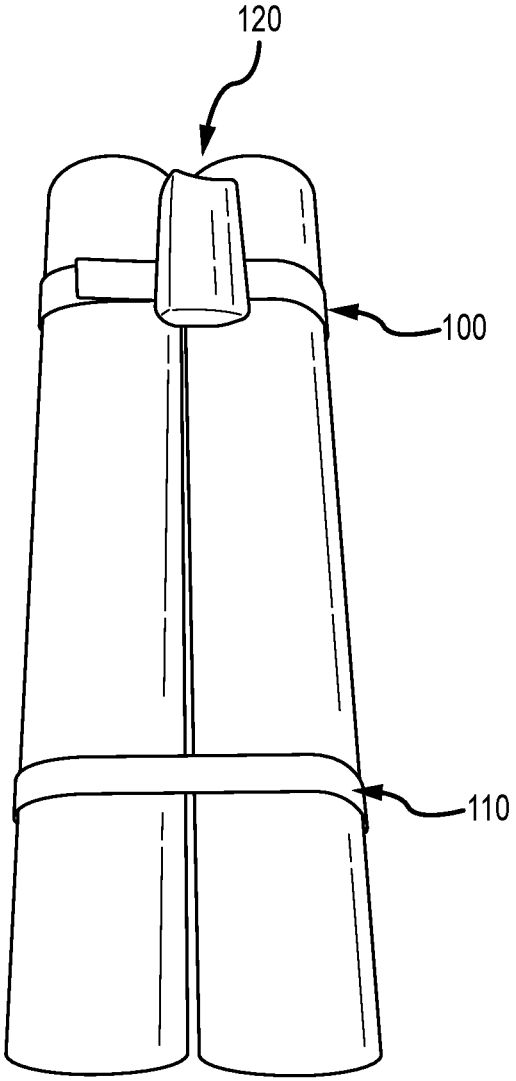
FIG. 7D is a picture of the foam rollers of FIG. 1 with the support pillow of FIG. 7C and at least two sets of straps of either FIG. 2 or 2A securing the rollers together.
Figure 9:
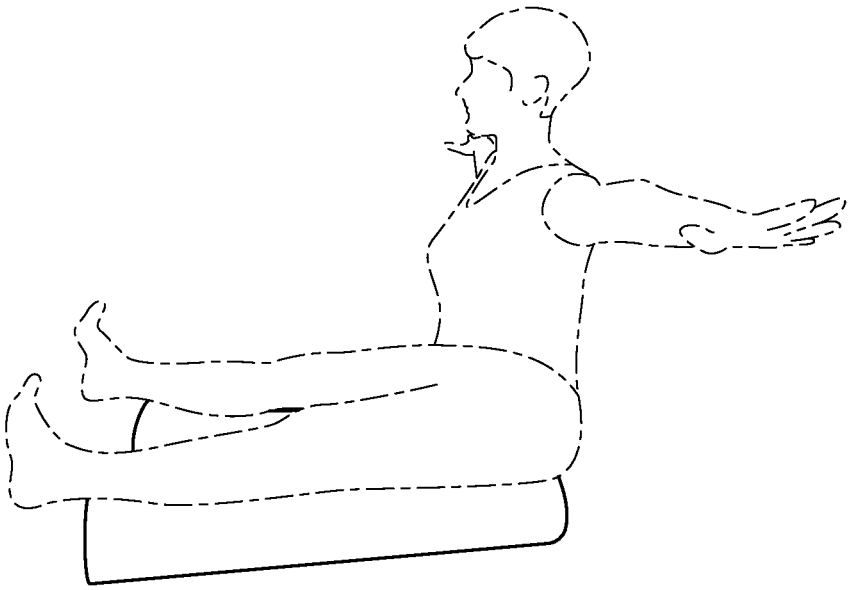
Figure 10:
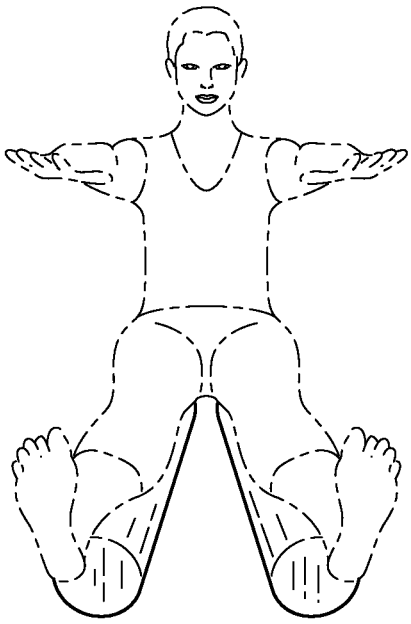

Once the foam rollers are either molded or removably secured to each other (as shown in FIGS. 5, SA, 5B and 7A), the duet foam roller system may be utilized to perform various exercises in a parallel position, as shown in FIGS. 6 and 7. For additional stability, multiple straps 100, 110 may be used as shown in FIG. 7B. In addition, a pillow 120 may be provided as shown in FIGS. 7C and D. When only one of the systems of straps as shown in FIGS. 5, 7B and 7D is used, the orientation of the foam rollers may be adjusted to position the free ends of the foam rollers to form a generally V-shaped system to allow additional stability exercises to be performed as depicted in FIGS. 8, 9 and 10.

The straps contemplated for use and depicted generally in FIGS. 2 and 3 through 5 is a system of two straps 30, 40 made from a woven cloth strap that wrap around each individual roller and then connect to each other, allowing for multiple positions of the rollers to be easily achieved as well as providing stability of the apparatus. As an alternative, a single strap 50 may be used as shown in FIGS. 2A and 7A. An even further alternative may be the strap combination 60, 70 of FIG. 2B utilizing two sets of mating connectors 82, 84 and 92, 94. In addition, a system of one or more straps made from elastic that secure the foam rollers to each other and allow for multiple positions of the rollers to be easily achieved as well as providing stability of the apparatus. Each of such strap systems or combinations may also include a "separator" that may be made from foam or other material, like the pillow 120 depicted in FIGS. 7C and 7D to aid in maintaining the "V" position of the duet roller system when the free ends of the rollers are separated.

Figure 20:
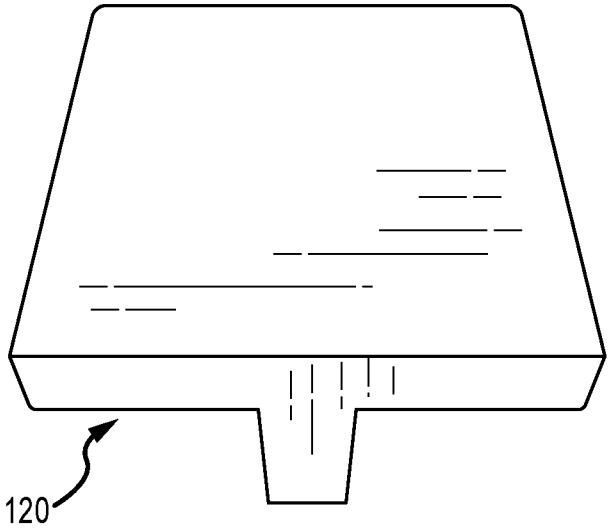
Figure 21:
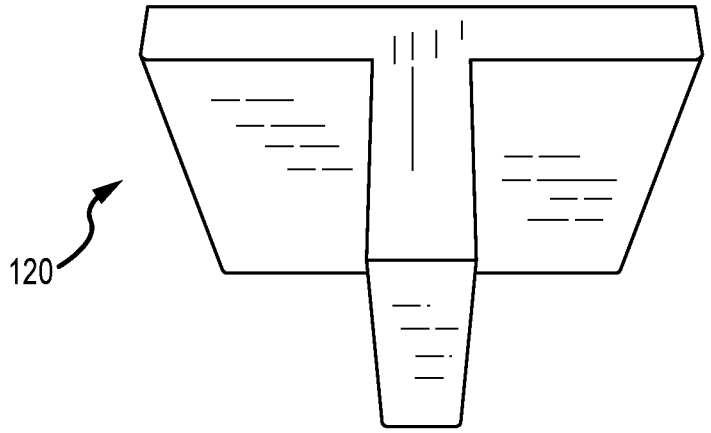
Figure 22:
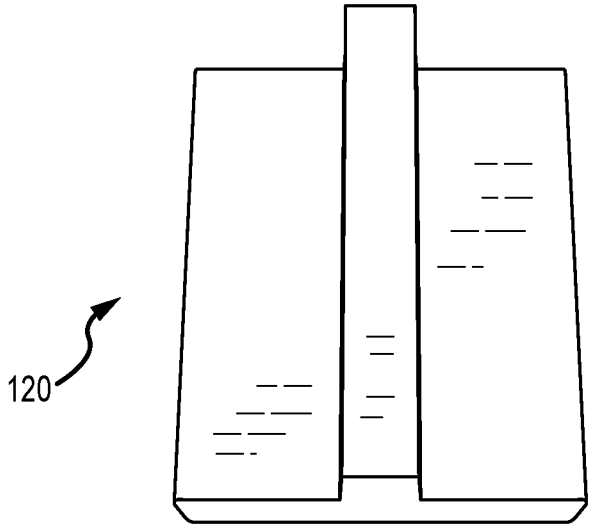
Figure 23:
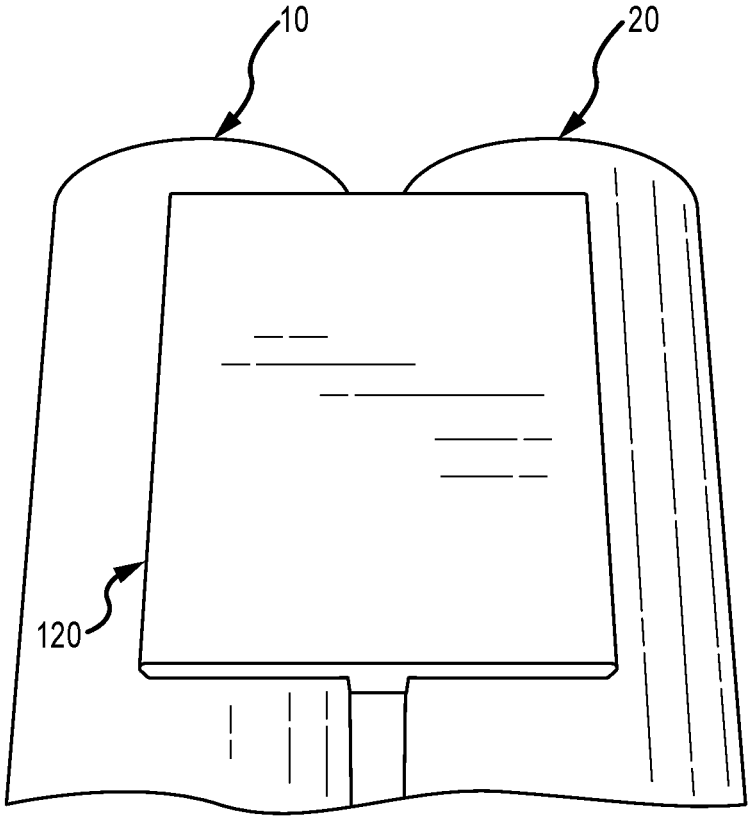
FIGS. 23 and 24 depict the T-shaped configuration shown in FIGS. 19 through 22 used as a head rest to nest on top of the foam rollers and support the user's head when the rollers are side by side as shown in FIGS. 5 through 7D.
Figure 24:
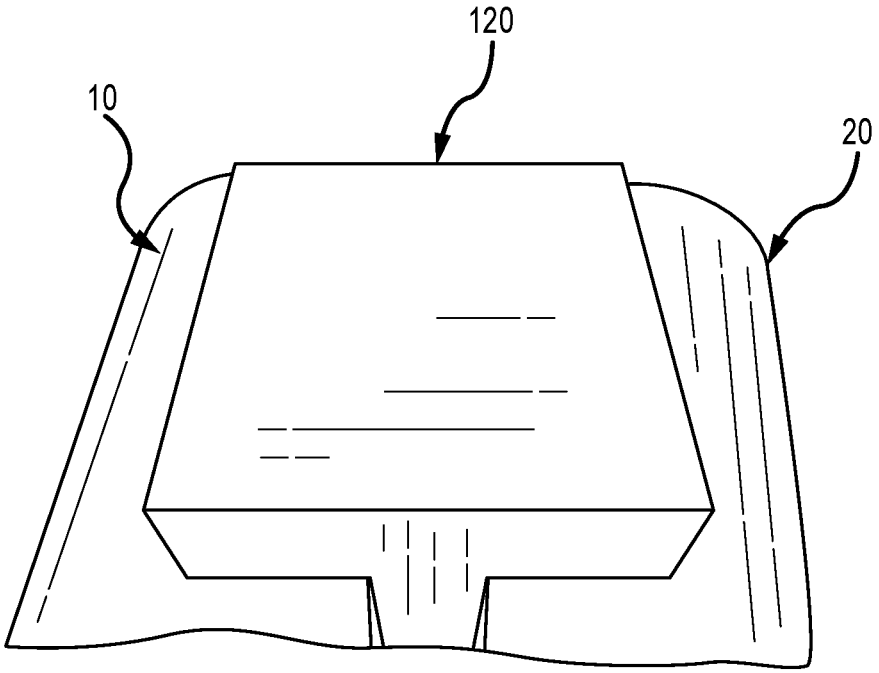
Figure 25:
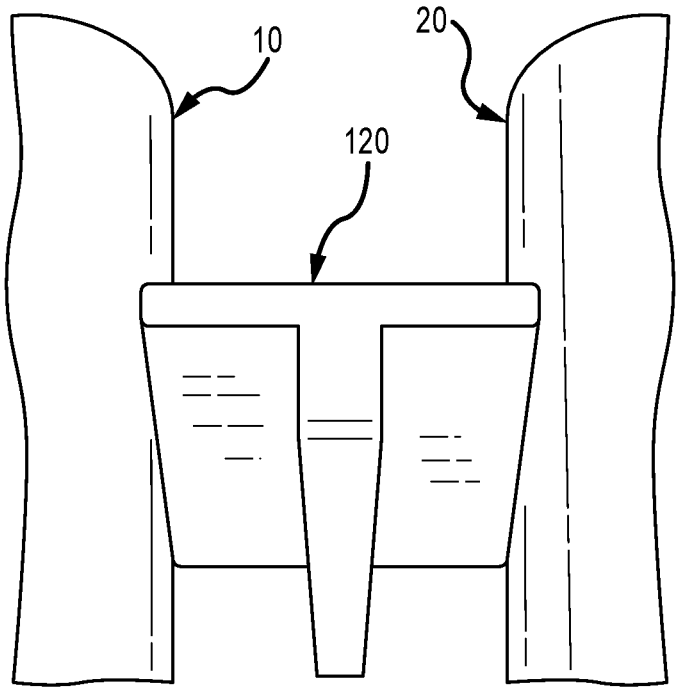
FIGS. 25 and 26 depict the T-shaped configuration shown in FIGS. 19 through 22 used as a wedge or spacer that is placed between the foam rollers when they are opened in a V-shape position as shown in FIGS. 8 through 10 and 14
Figure 26:
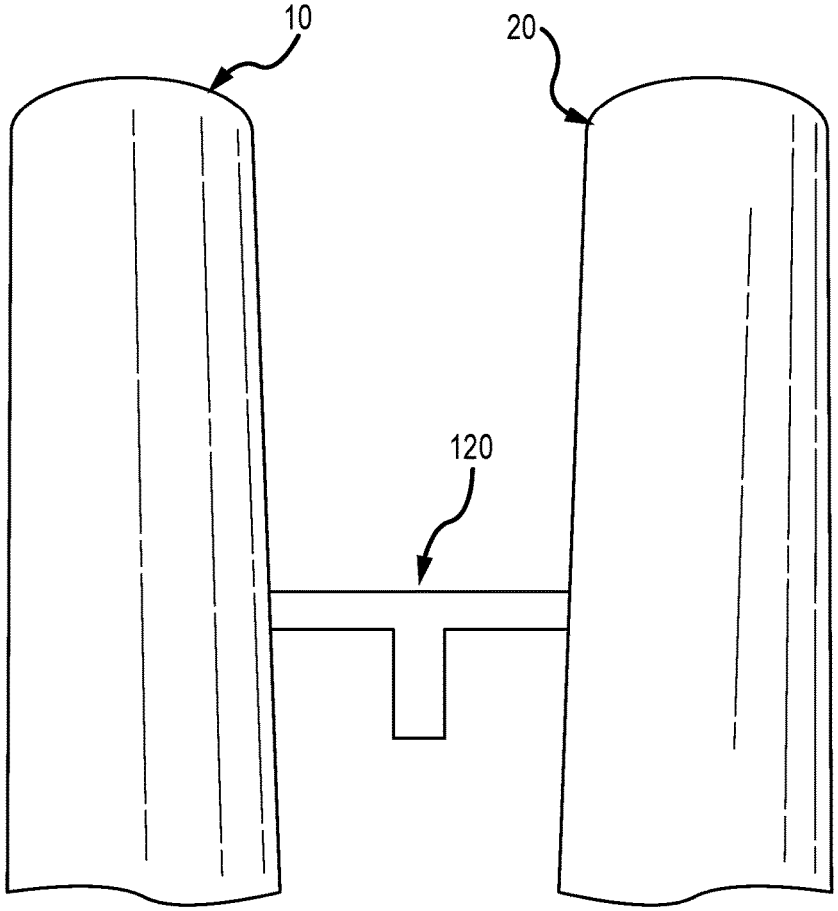

Another embodiment of the present invention may include a support and spacing accessory 120 as shown in FIGS. 19 through 22. That accessory has a T-shaped configuration (as shown in FIGS. 20-22) and may be used as a head rest 120 to nest on top of the foam rollers 10, 20 and support the user's head when the rollers are side by side as shown in FIGS. 23 through 24. That same accessory 120 may be used as shown in FIGS. 25 and 26 as a wedge or spacer that is placed between the foam rollers 10, 20 when they are opened in a V-shape position as shown in FIGS. 8 through 10 and 14. The T-shaped accessory may be made, in part, from the same materials as the foam rollers. That accessory may also be made from other materials that provide sufficient strength and durability to provide the support and spacing needed.

Figure 13:
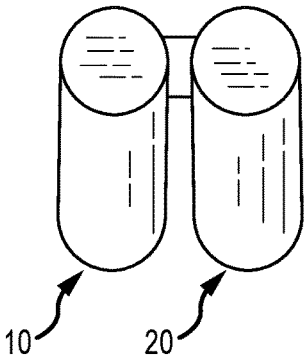
FIGS. 13 and 14 are depictions of an alternative embodiment of the duet foam roller system using two caps which have extension "lips" that are connected by a hinge mechanism so that the one end of each roller may be inserted into each cap to be held together for various exercises and then may be separated into a V-shaped arrangement.
Figure 14:
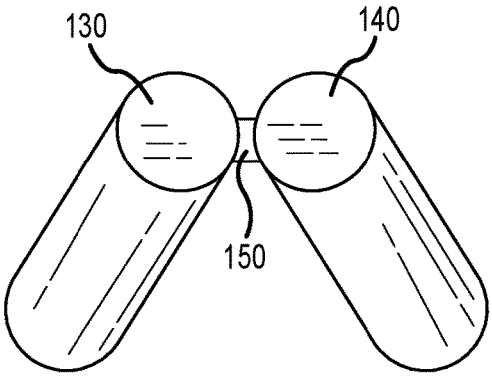

A further embodiment of the present invention may include a cap holder system as depicted in FIGS. 13 and 14. In that system, two caps 130, 140 that will fit around the respective ends of each of the foam rollers 10, 20 are provided, with each cap having an extension "lip" which is connected to each other by a hinge mechanism 150. The ends of each roller may be inserted into each cap respectively to hold the rollers in parallel (as shown in FIGS. 6 and 7) for various exercises and then separated into a "V" for other seated exercises (as shown in FIGS. 8, 9, and 10).

Figure 11:
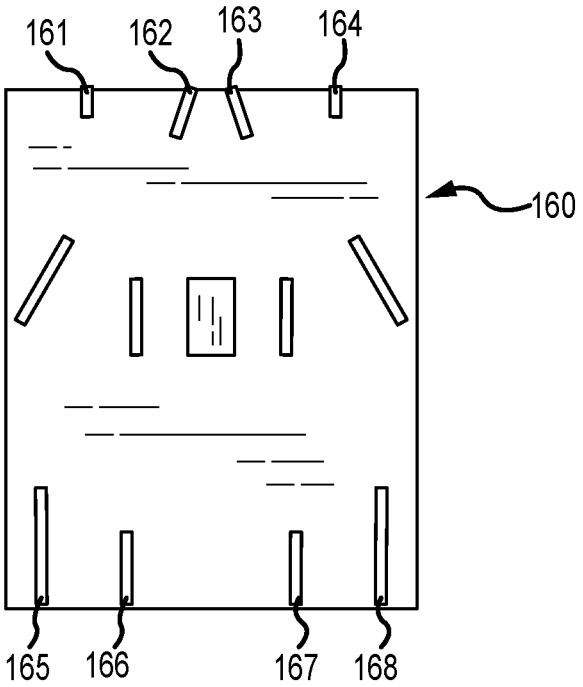
FIG. 11 is a picture of a rough prototype of a nesting mat which may be used with the duet foam roller system to provide further stability in the use of the system.
Figure 12:
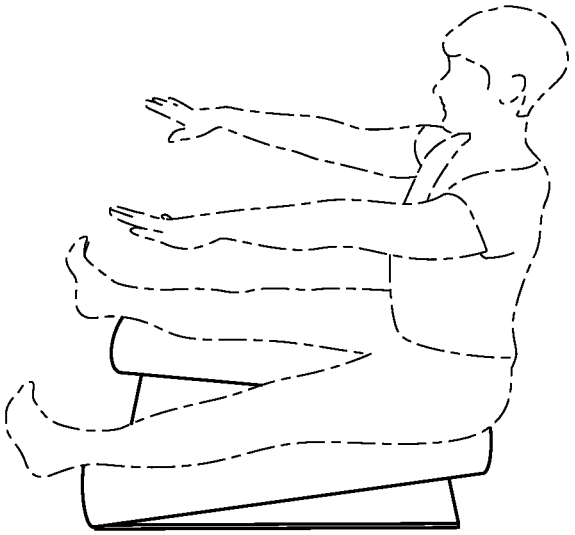
FIG. 12 is a picture of the duet foam roller system utilizing the prototype nesting mat to provide further stability in the use of the system.
Figure 15:
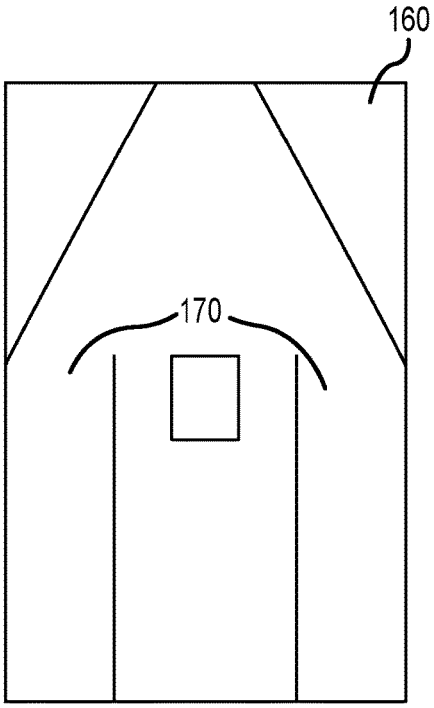
FIG. 15 is a depiction of the mat in which grooves or raised sections are provided to allow the duet foam roller system to nest to provide additional stability when the system is used.
Figure 16:
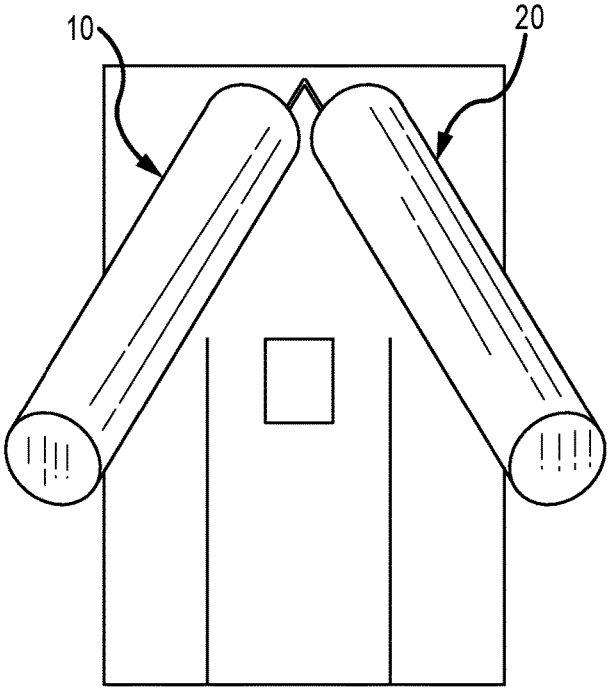
FIG. 16 is a depiction of the duet foam roller system of FIG. 12 used with the nesting mat of FIG. 15.

In a further embodiment of the present invention, a mat 160, as depicted in FIGS. 11 and 15 may be used. The mat is of a standard product in the Pilates world as well as other physical fitness disciplines. For this invention, the preferred mat would be a "nesting mat", that is, a mat that provided with a series of raised portions 161 through 168 as shown in FIG. 11 or grooves 170 as shown in FIG. 15 that allow the rollers 10, 20 of the duet foam roller system to "nest" into grooves or channels form in the mat and would allow for multiple positions for the duet foam roller system. FIGS. 12 and 16 depict some of the positions that would be available using a combination of the duet foam roller system and nesting mat of the present invention.

Figure 17:
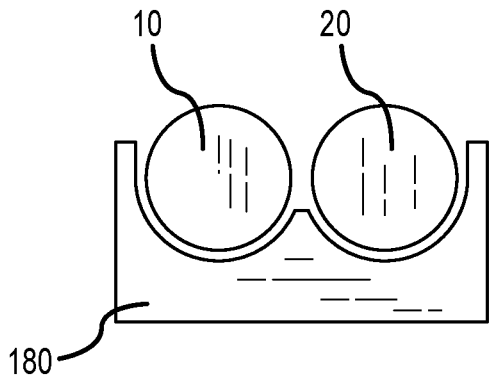
FIGS. 17 and 18 are depictions of an alternative embodiment of the duet foam roller system using one or more nesting blocks to maintain the duet foam roller system in a parallel but separate configuration.
Figure 18:
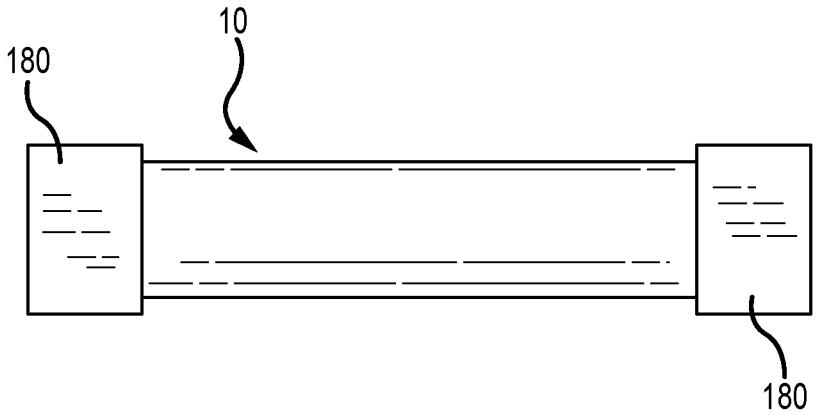
Figure 19:
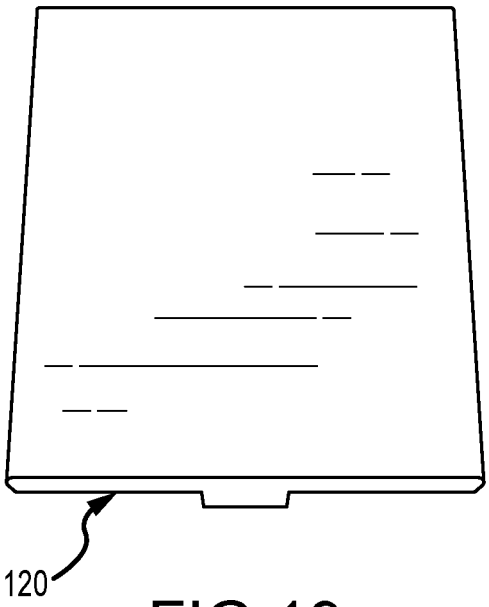
FIGS. 19 through 22 are depictions of a further embodiment of a support and spacing accessory in the form of a T-shaped configuration.

In still a further embodiment of the present invention, one or more nesting blocks 180, as depicted in FIGS. 17 and 18, may be used to further hold the foam rollers 10, 20 in parallel positions, with or without straps. As shown in FIGS. 17 and 18, one or more blocks 180, with channels in which each foam roller may be placed, may be provided for further stability of the duet roller system when used in parallel. The nesting block may extend along the entire length of the foam rollers or along just a portion of foam rollers. In addition, multiple nesting blocks may be provided, such as one at each end of the duet rollers for increased stability. If a single nesting block is used at one end, the foam rollers may be separated into a modified "V" position any may be used with a separator to provide further stability.

Although the present invention has been described in terms of the preferred embodiments, it is to be understood that such disclosure is not intended to be limiting. Various alterations and modifications will be readily apparent to those of skill in the art.

What is claimed is:

1. A system for use in allowing a person to perform a variety of exercises in a stable prone, side lying or seated position comprising:

two foam rollers of substantially equal dimensions each having a first end and a second end, wherein the rollers are removably attached to each other by at least one restraining device which holds the two foam rollers in a substantially parallel position when used; and a removable headrest having a T shaped configuration positionable at the first ends of the two foam rollers when the rollers are in the substantially parallel position.

2. The system of claim 1 wherein the restraining device is at least one strap of a flexible but sturdy material having opposite ends that may be wrapped around each of the foam rollers with the opposite ends of the strap being removably connected to hold the foam rollers together.

3. The system of claim 2 wherein multiple straps are wrapped around each of the foam rollers along their length with the opposite ends of each strap being removably connected to hold the foam rollers together.

4. The system of claim 2 wherein the restraining device is a strap having a Y-configuration with at least two sets of male/female connectors located thereon wherein one portion of the strap may be wrapped and removably secured around one foam roller and the other portion of the strap may be wrapped and removably secured around both foam rollers to hold the foam rollers together.

5. The system of claim 1 wherein the restraining device is a nesting block.

6. A system for use in allowing a person to perform a variety of exercises in a stable seated position comprising:

two foam rollers of substantially equal dimensions each having a first end and a second end removably attached to each other at the first ends by at least one restraining device wherein the restraining device allows the foam rollers to separate at their second ends to form a substantially V-shaped configuration when used; and removable stabilizing member positionable between the two foam rollers when the rollers are in the V-shaped configuration.

7. The system of claim 6 wherein the restraining device is at least one strap having opposite ends of a flexible but sturdy material that may be wrapped around respective first ends of each of the foam rollers with the opposite ends of the strap being removably connected together to hold the foam rollers together.

8. The system of claim 6 wherein the restraining device is a strap having a Y-configuration with at least two sets of male/female connectors located thereon wherein one portion of the strap may be wrapped and removably secured around the first end of one foam roller and another portion of the strap may be wrapped and removably secured around both foam rollers at the first ends to hold the foam rollers together.

9. The system of claim 6 wherein the restraining device is a set of caps wherein each cap is positioned at the first ends of each foam roller when the foam rollers are parallel to each other and the caps are hingedly connected to each other to allow the foam rollers to be separated at their respective second ends to form the V-shaped configuration.

10. The system of claim 6 wherein the stabilizing member has a T-shaped configuration.

11. The system of claim 6 wherein a stabilizing nesting mat is provided to allow the foam rollers to be positioned in V-shaped positions which vary in depth depending upon the placement of the foam rollers on the mat.

12. A system for use in allowing a person to perform a variety of exercises in a stable position comprising:

two foam rollers of substantially equal dimensions each having a first end and a second end which may be removably attached to each other by at least one restraining device positioned at or near the first end of each of the foam rollers which initially holds the two foam rollers in a substantially parallel position for prone or side-lying use;

wherein the restraining device allows the foam rollers to be separated at their second ends ends to form a V-shaped configuration for use in a seated position; and a stabilizing member positionable between the foam rollers, when the foam rollers are in the V-shaped configuration to maintain the s stem in the V-shaped configuration.

13. The system of claim 12 wherein the restraining device is at least one strap having opposite ends of a flexible but sturdy material that may be wrapped around the first ends of each of the foam rollers with the opposite ends of the strap being removably connected together to hold the foam rollers together.

14. The system of claim 12 wherein the stabilizing member has a T-shaped configuration.

* * * * *